US005437458A

United States Patent [19]

Springer

[11] Patent Number: 5,437,458

[45] Date of Patent: Aug. 1, 1995

[54] GOLF PUTTING TRAINING DEVICE

[76] Inventor: A. L. Springer, 2120 Hillcrest, Pekin, Ill. 61554

[21] Appl. No.: 56,926

[22] Filed: Jul. 19, 1993

[51] Int. Cl.[6] ..... A63B 69/36

[52] U.S. Cl. ..... 273/192; 273/194 A; 273/DIG. 30

[58] Field of Search ..... 273/192, 186, 194 A, 273/186.1, 35 A, DIG. 30, 196, 188 A

[56] References Cited

U.S. PATENT DOCUMENTS

| | | | |
|---|---|---|---|
| D. 245,438 | 8/1977 | Thiel . | |
| D. 245,439 | 8/1977 | Thiel . | |
| 1,545,648 | 7/1925 | Fletcher . | |
| 2,303,736 | 12/1942 | Hall . | |
| 2,463,798 | 3/1949 | Paisley . | |
| 2,894,755 | 7/1959 | Scelzo . | |
| 3,073,602 | 1/1963 | Bell . | |
| 3,104,108 | 9/1963 | Robertson . | |
| 3,273,891 | 9/1966 | Grim . | |
| 3,471,155 | 10/1969 | Donaldson . | |
| 3,885,796 | 5/1975 | King . | |
| 3,899,180 | 8/1975 | Rodman . | |
| 3,934,874 | 1/1976 | Henderson | 273/192 |
| 4,133,535 | 1/1979 | Marsh . | |
| 4,153,255 | 5/1979 | Woodson . | |
| 4,334,684 | 6/1982 | Sterling . | |
| 4,413,824 | 11/1983 | King . | |
| 4,437,669 | 3/1984 | Pelz | 273/192 |
| 4,842,280 | 6/1989 | Hilton . | |
| 5,072,943 | 12/1991 | Sindelar . | |
| 5,116,057 | 5/1992 | Mangiaracina | 273/DIG. 30 |
| 5,152,534 | 10/1992 | Sindelar . | |

FOREIGN PATENT DOCUMENTS 2020983 11/1979 United Kingdom .

OTHER PUBLICATIONS

Advertisements for Putting Stroke Trainers as seen in "Golf" Magazine, Jan. 1992 issue, pp. 45–47.

*Primary Examiner*—Sebastiano Passaniti
*Attorney, Agent, or Firm*—Mark E. Wiemelt

[57] ABSTRACT

A golf putting training device for improving putting strokes comprising, in combination, a conventional golf putter having a shaft and a putter head, a slider connectible to the putter head and being adapted to be used in connection with a pair of elongated guide elements. The guide elements being disposed in horizontal, spaced parallelism, and coacting with the slider in tongue-in-groove fashion. The slider and putter head being translated along the length of the guide elements and substantially perpendicular thereto, whereby the putter head approaches and strikes a golf ball positioned proximate an end of the guide elements and intermediate them. The guide elements being adapted to cooperate with the slider so that the longitudinal axis of the putter head is maintained substantially horizontal and perpendicular to a desired path of putter head travel. The device encourages a generally arcuate putting stroke whereby the putter strikes the golf ball while on its upswing producing rotational spin on a golf ball propelling it forward in a rolling motion. The putter is released from the device after impact with the golf ball, thereby allowing an unrestricted and unguided follow-through. A reflective surface properly positions the golfer with respect to the device and golf ball and repeated use conditions the golfer to maintain proper putting form, head positioning, and eye positioning during the backswing, approach, impact, and follow-through.

6 Claims, 4 Drawing Sheets

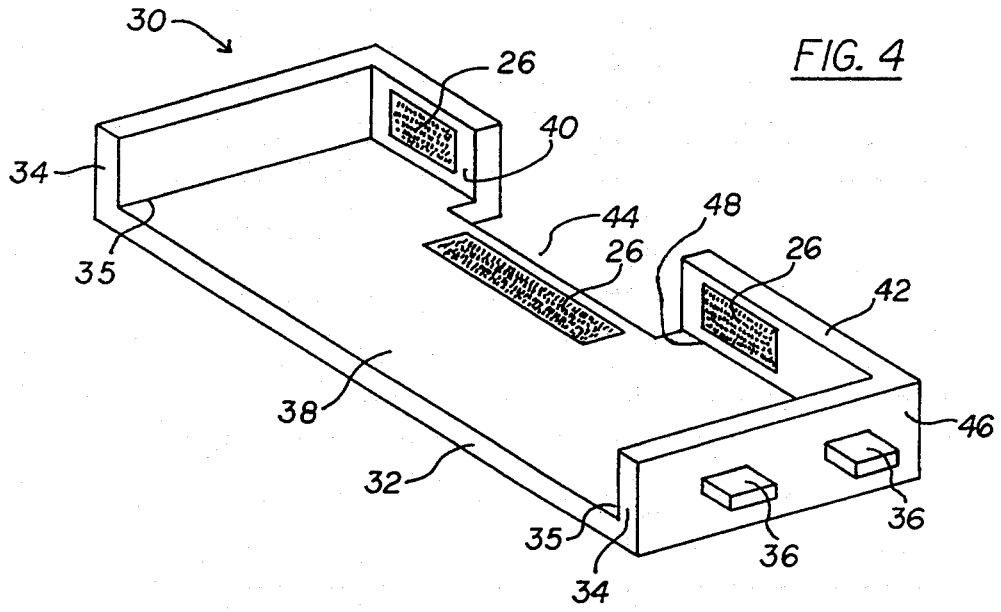
FIG. 4
FIG. 5
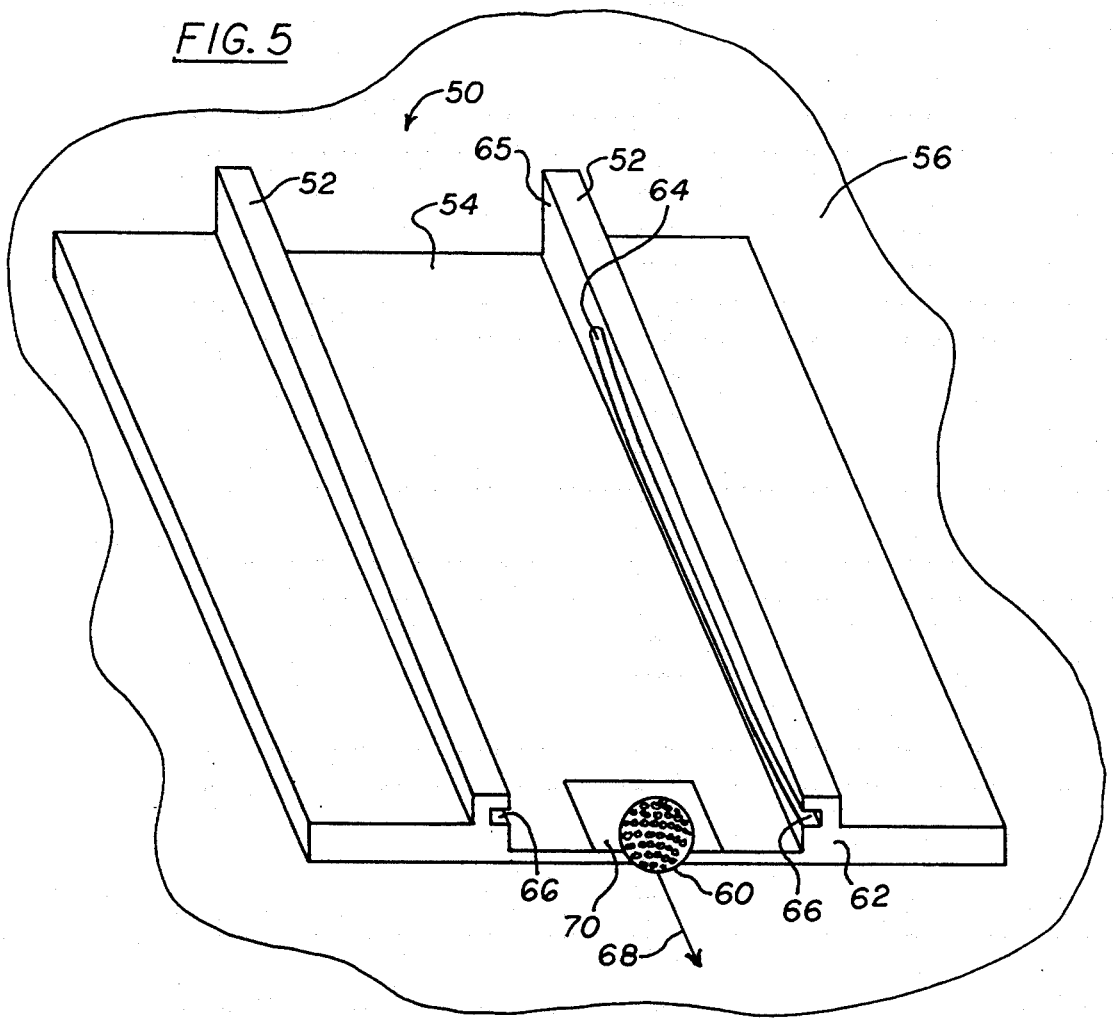

GOLF PUTTING TRAINING DEVICE

BACKGROUND OF THE INVENTION

The present invention relates generally to a new and improved golf putting training device, and in particular to a device for training a golfer's putting stroke by teaching proper translation and orientation of a putter head during its backswing, approach, impact with a golf ball, and follow-through.

Numerous devices have heretofore been proposed for teaching proper putting form, and these have included devices having the object of improving the golf game by encouraging repetitious simulation of a putting stroke whereby the golfer's memory and motor nervous system are conditioned to consistently employ the desired putting stroke. However, each of these devices have been found wanting in one or more particulars, such as teaching a putting stroke whereby the golf ball is initially propelled across the putting surface in a skidding fashion, rather than the preferred rolling translation caused by rotational spin imparted to a golf ball. The prior devices also failed to allow unrestricted putter follow-through after impact with the golf ball. In addition, the prior devices were not adapted for use by golfers of various heights employing putting strokes with various radii of curvature. The putting training device of this application represents a recent innovation in the art.

SUMMARY OF THE INVENTION

It is an object of the present invention to provide a golf putting training device which will enable the user to develop a correct putting stroke by teaching the golfer to repetitiously simulate a desired putting stroke.

More specifically, it is an object of the present invention to provide a golf putting training device in accordance with the foregoing object which encourages guided and restricted putter head translation to develop a conditioned, subconscious, golfer memory and motor nervous response during the putting stroke which persists even when the device is not being used.

It is another object of the present invention to provide a golf putting training device which teaches a putting stroke which creates rotational spin on the ball so that the ball begins rolling, rather than skidding, along the putting surface.

It is yet another object of the present invention to provide a golf putting training device in accordance with the foregoing objects which teaches a putting stroke in which the putter head translates along a generally arcuate path.

It is still another object of the present invention to provide a golf putting training device in accordance with the foregoing object which approaches and strikes a golf ball while the putter head is on its upswing.

It is a further object of the present invention to provide a golf putting training device which teaches proper putting stance, head positioning, and body alignment during the backswing, approach, impact and follow-through.

It is still another object of the present invention to provide a golf putting training device in accordance with the foregoing object which teaches a golfer to maintain his or her head in a fixed position during the backswing, approach, impact, and follow-through.

It is still another object of the present invention to provide a golf putting training device in accordance with the foregoing objects which is adapted for use by golfers of various heights employing putting strokes with various radii of curvature.

It is another object of the present invention to provide a golf putting training device which allows unrestricted, unguided follow-through after a golf ball is struck by a putter.

It is still another object of the present invention to provide a golf putting training device in accordance with the foregoing objects which can be used equally by right or left-handed golfers.

It is yet another object of the present invention to provide a golf putting training device in accordance with the foregoing objects which is simple in design, inexpensive to manufacture, portable, lightweight, and which can be employed with any putter.

A broad aspect of the invention involves a golf putting training device for improving putting strokes. The invention is adapted for use with a putter having a shaft and a putter head defined at a first end of the shaft. The invention includes a slider and a means for attaching the slider to the putter head. Guide means are provided to cooperate with the slider so that the longitudinal axis of the putter head is maintained substantially horizontal and perpendicular to a desired path of putter head travel.

A somewhat more limited aspect of the invention involves a putter training device including a reflective surface for positioning a golfer's eyes vertically above a point adjacent the backside of the golf ball and in line with a desired path of the ball during a putting backswing, approach, impact and unrestricted follow-through. A pair of elongated guide elements cooperate in tongue-in-groove fashion with a slider connected to a golf putter to define a generally arcuate path of travel of the putter head as it approaches and strikes a golf ball lying on a putting surface. The putter head strikes the ball while on its upswing causing the ball to be propelled with rotational spin across the putting surface along a desired path of travel. The guide elements define generally arcuate grooves having varying widths along the length of the guide elements thereby facilitating putting strokes with various radii of curvature. The guide elements also terminate in open recesses at the front end of the device releasing the putter for unrestricted translation during the follow-through.

Other objects, features, capabilities and advantages are comprehended by the invention, as will later appear and as are inherently possessed thereby.

BRIEF DESCRIPTION OF THE DRAWINGS

FIG. 4 is a perspective view from the rear of an embodiment of a slider constructed according to the principles of the present invention;

FIG. 5 is a perspective view of an embodiment of a guide means constructed according to the principles of the present invention;

Corresponding reference numerals indicate corresponding parts throughout the several views of the drawings.

DETAILED DESCRIPTION OF THE PREFERRED EMBODIMENT

Figure 1:
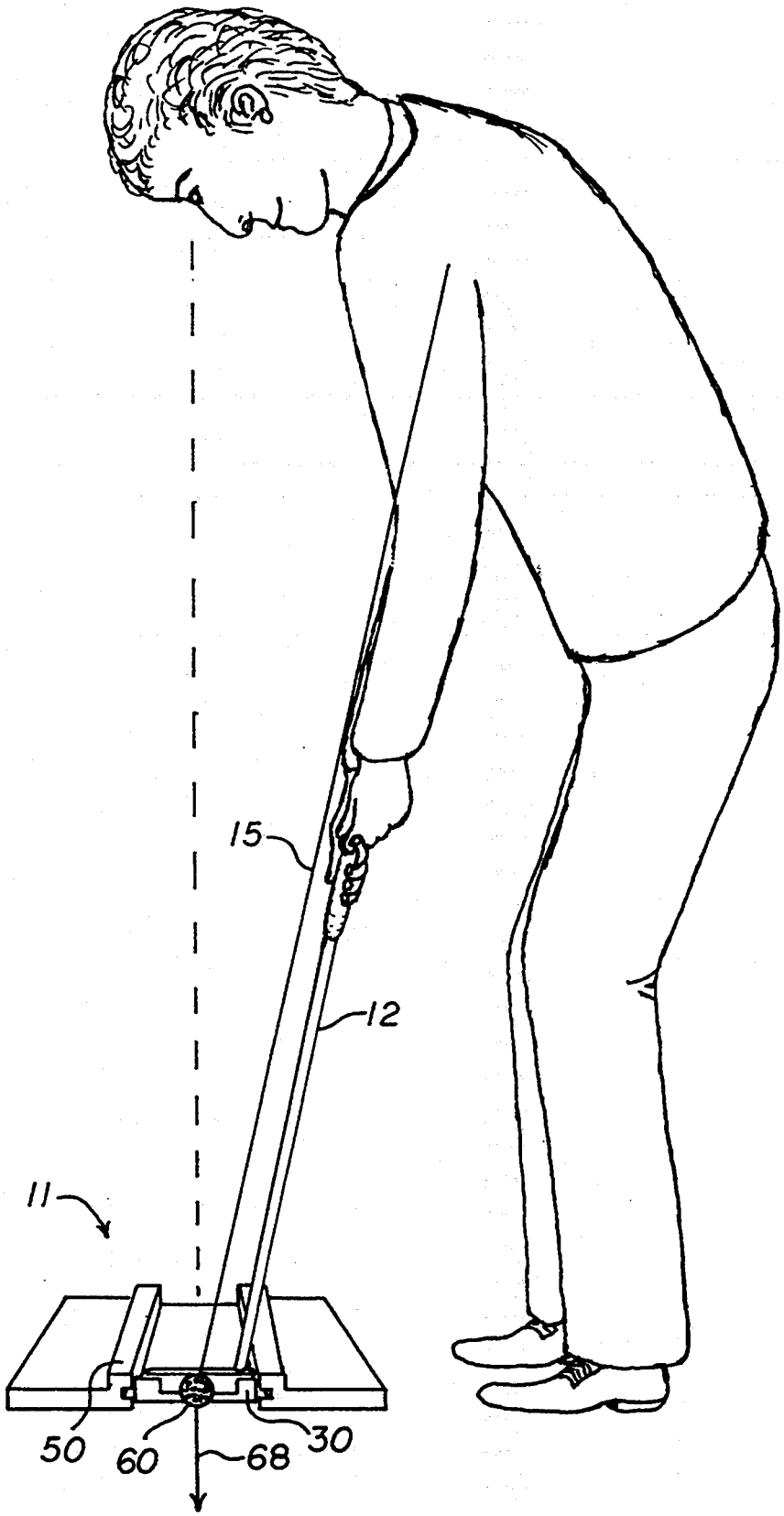
FIG. 1 is a perspective view of a golf putting training device constructed according to the principles of the present invention in combination with a golfer illustrating the proper putting stance, the cooperation between the slider and guide means, the placement of the golf ball, and the desired path of the ball.

Referring now to the drawings in detail there is illustrated in combination with a golfer a preferred form of the golf putting training device in accordance with the principles of the present invention and designated generally in its entirety by the reference numeral 11 in FIG. 1.

Figure 2:
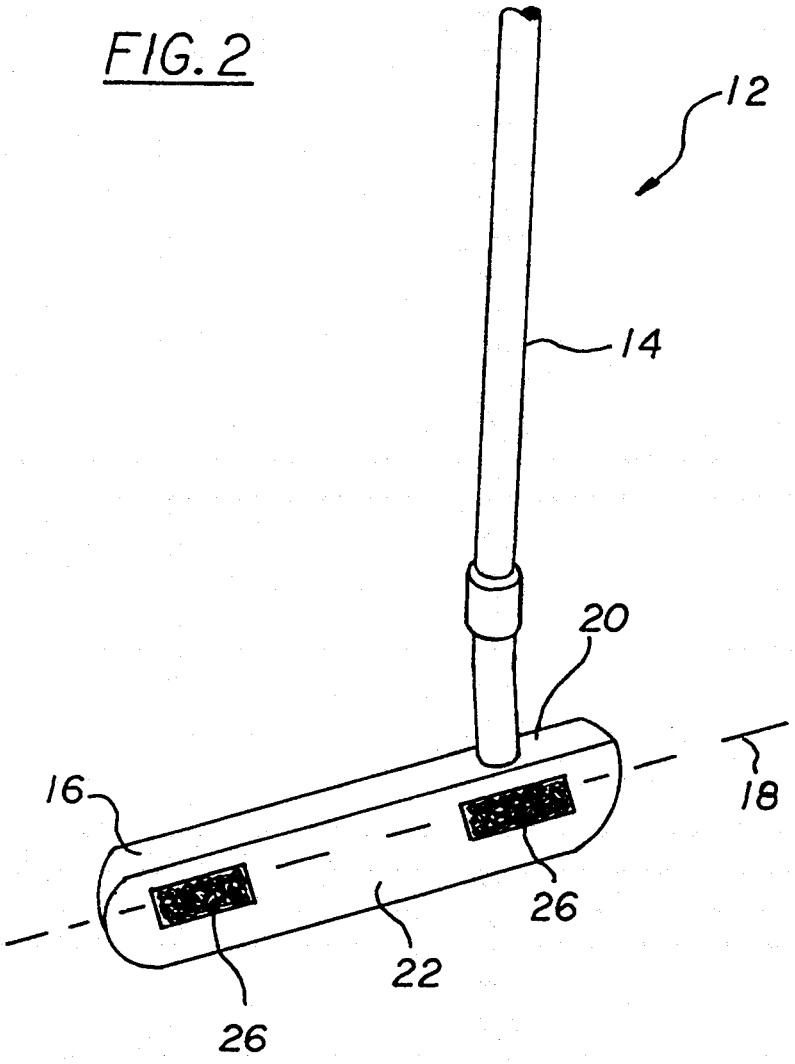
FIG. 2 is a perspective view of the lower portion of a putter to be used in combination with the present invention, illustrating a putter face, a longitudinal axis of the putter head, and attachment means connected to the putter face.
Figure 3:
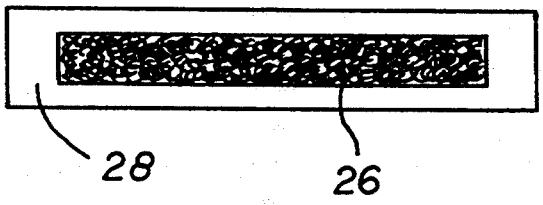
FIG. 3 is a bottom view of the sole of the putter, illustrating attachment means connected thereto.

In the preferred embodiment, the device 11 is adapted for use with a conventional golf putter designated generally by reference numeral 12, as shown in FIGS. 1 and 2, and comprises a slider designated generally by reference numeral 30, as shown in FIG. 4, a means 26 for attaching the slider 30 to the golf putter 12, as shown in FIGS. 3 and 4, and a guide means generally designated by reference numeral 50, as shown in FIG. 5.

In the preferred embodiment, the golf putter 12 comprises a shaft 14 and a putter head 16 having a longitudinal axis 18 defined at a first end 20 of the shaft 14. The putter head 16 is provided with a putter face 22, a sole 28, and attachment means 26 connected to the putter face 22 and sole 28. Preferably the attachment means 26 consist of Velcro-type hook-and-loop material.

The slider 30, as shown in FIG. 4, preferably comprises a planar rectangular plate 32, a pair of side walls 34 integrally formed with and projecting perpendicularly upward from opposite ends 35 of the plate 32, and a front wall 42 also integrally formed with and projecting perpendicularly upward from the front end 48 of the plate 32. Attachment means 26 are disposed along the top 38 of the plate 32 and the back face 40 of the front wall 42. The outer faces 46 of the side walls 34 each contain one or more tongues 36 integrally formed with and projecting perpendicularly outward therefrom. The front wall 42 and plate 32 form an opening 44 for receiving the putter face 22. Preferably, the slider 30 is constructed of injection-molded plastic.

The guide means 50 of the preferred embodiment shown in FIG. 5 comprise first and second elongated guide elements designated generally as 52 which are disposed in horizontal, spaced parallelism by a horizontal, planar base 54 lying on a putting surface 56 and positioned between and connected to the guide elements 52 and extending laterally outwardly from the guide elements 52 for stability. The guide means 50 is also preferably constructed of injection-molded plastic.

In the preferred embodiment, as shown in FIGS. 5, 7, 8, and 9, the guide elements 52 define arcuate grooves 64 of varying width extending substantially the length of interior facing surfaces 65 of the guide elements 52 and terminating at the front end 62 of the device 50 defining open recesses 66.

To illustrate the invention, FIG. 5 shows a reflective surface 70 for positioning the reflection of a golfer's eyes immediately behind and adjacent the golf ball 60 and in line with the desired putting path 68 of the golf ball 60. The preferred reflective surface 70 is a polished chrome plate, although it is to be understood that many suitable replacements are contemplated.

Figure 6:
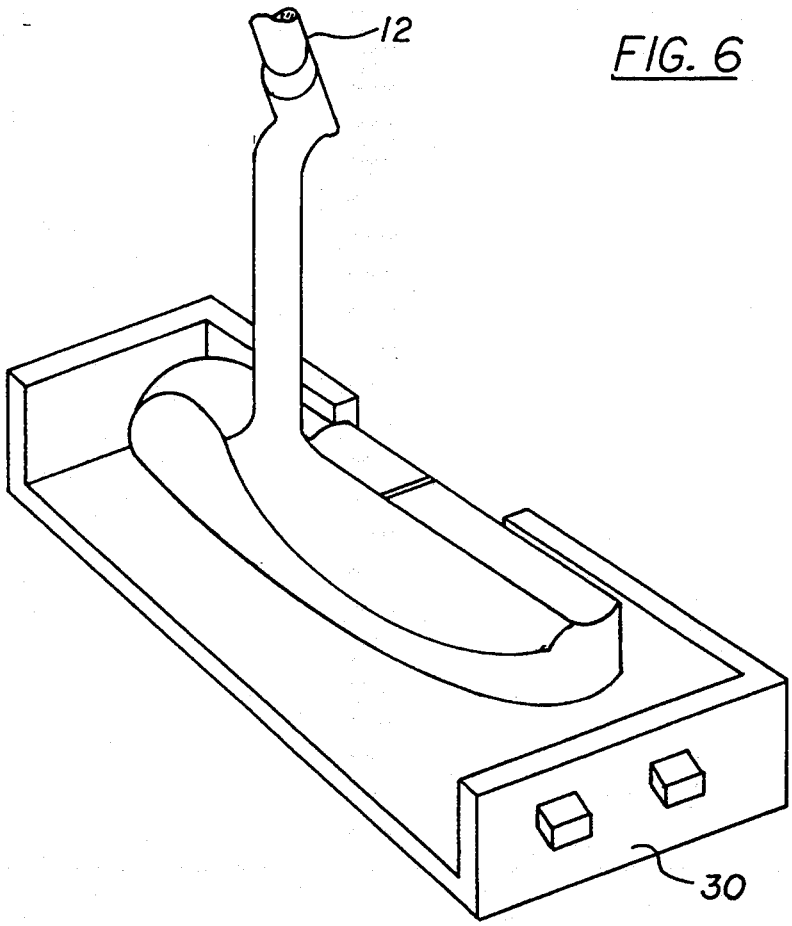
FIG. 6 is a perspective view of the lower portion of the putter and the slider, illustrating the cooperation between the two.
Figure 7:
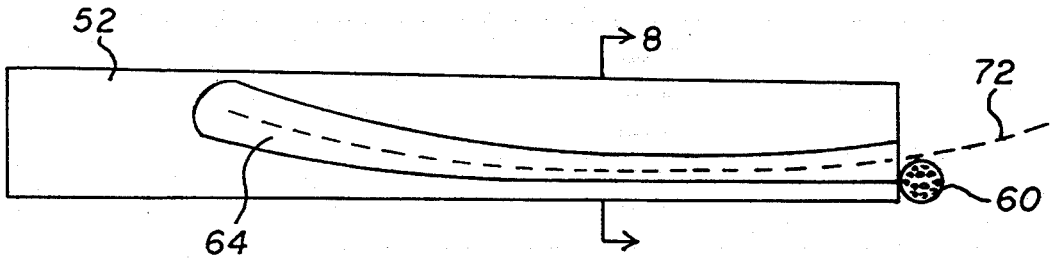
FIG. 7 is a side view of an embodiment of a guide element constructed according to the principles of the present invention, illustrating the arced grooves of varying width, the desired path of putter head travel, and the positioning of a golf ball at rest.
Figure 8:
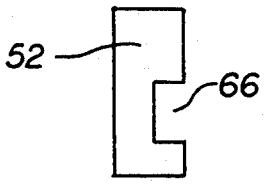
FIG. 8 is a cross-sectional view of a guide element taken along line 8—8 of FIG. 7.
Figure 9:
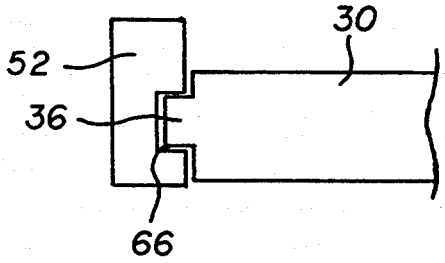
FIG. 9 is a cross-sectional view of a guide element taken along line 8—8 of FIG. 7 additionally illustrating a sectional view of a slider and the tolerance fit between a tongue of a slider and a groove of a guide element constructed according to the principles of the present invention.

FIG. 6 illustrates the cooperation between the putter 12 and the slider 30.

The grooves 64 of the guide elements 52 are adapted to cooperate with the tongues 36 of the slider 30 so that the longitudinal axis 18 of the putter head 16 is maintained substantially horizontal and perpendicular to the desired path of putter head travel 72. The varying width of the grooves 64 allows the device 11 to be employed by golfers having putting strokes with various radii of curvature 15.

OPERATION

In operation, the device 11 is placed on a putting surface 56, or any generally flat surface, with the guide elements 52 disposed parallel to the desired path 68 of the ball 60 on either side of the ball 60. The combination putter head 16 and slider 30 are attached to each other by interaction of the hoop-and-loop material provided on each of them. The slider 30 is then positioned intermediate the guide elements 52 and in tongue in-groove interaction therewith. The ball 60 is then placed on the putting surface 56 adjacent the front end 62 of the device 11 and the reflective surface 70. The golfer then assumes a position with his or her feet equidistant from the golf putting training device 11, bending from the waist and aligning the reflection of his or her eyes immediately behind and adjacent the golf ball 60 and in line with the desired putting path 68 of the golf ball 60. The golfer next translates the putter head 16 backwards away from the ball 60, and then forward, along the desired path of putter head travel 72, toward and through the ball 60 on the putter head's upswing, thereby causing impact with the ball 60 and propelling the ball 60 forward along the desired putting path 68 of the ball 60 by creating rotational spin on the ball 60. After impact with the ball 60, the combination slider 30 and putter 12 are released from the guide means 50 at open recesses 66 and allowed to translate unguided and unrestricted during the follow-through.

The golfer should attempt to maintain eye contact in the reflective surface 70 during the follow-through in order to maintain proper head positioning during the impact and follow-through.

In operation, the longitudinal axis 18 of the putter head 16 is translated substantially horizontally and perpendicular to the desired path of putter head travel 72 at all times.

As the user repetitiously manipulates the slider 30 and putter head 16 through the desired putting stroke, he or she will develop a natural, conditioned motor nervous response to consistently employ the desired putting stroke even when the device 11 is not being used.

In view of the above, it will be seen that the several objects of this invention are achieved and other advantageous results are obtained.

While the invention has been described in connection with a preferred embodiment, it will be understood that it is not intended that the invention be limited to that embodiment. On the contrary, it is intended to cover all alternatives, modifications and equivalents as may be included within the spirit and scope of the invention as defined by the appended claims.

I claim:

1. A golf putting training device for improving putting strokes, said device comprising, in combination:

a golf putter having a shaft and a putter head defined at a first end of said shaft, said putter head having a longitudinal axis;

a slider;

a means for attaching said slider to said putter head;

a guide means adapted to cooperate with said slider so that said longitudinal axis of said putter head is maintained substantially horizontal and normal to a desired path of putter head travel, said guide means terminating at a front end of said device, along said desired path of putter head travel beyond a point of impact of said putter head and a golf ball, allowing said putter head to translate unguided and unrestricted after impact with said golf ball.

2. A golf putting training device as set forth in claim 1 wherein said guide means define a generally arcuate path of putter head travel and wherein said putter head approaches and strikes a golf ball lying on a putting surface while said putter head is on its upswing whereby said ball is propelled with rotational spin across said putting surface.

3. A golf putting training device for improving putting strokes, said device comprising, in combination:

a golf putter having a shaft and a putter head defined at a first end of said shaft, said putter head having a longitudinal axis;

a slider having first and second slider ends and being adapted to be used in connection with said golf putter;

a means for attaching said slider to said putter head;

a guide means comprising first and second elongated guide elements respectively adapted to cooperate with said first and second slider ends, said slider and said putter head being translated along a desired path of putter head travel whereby said putter head approaches and strikes a golf ball positioned proximate an end of said guide elements and intermediate them, said guide elements terminating at a front end of said device along a desired path of putter head travel beyond a point of impact of said putter head and said golf ball and defining open recesses at said front end of said device, said open recesses allowing said putter head to translate unguided and unrestricted after impact with said golf ball; and a spacing means for maintaining said guide elements disposed in horizontal, spaced parallelism.

4. A golf putting training device as set forth in claim 3 wherein said guide elements define a generally arcuate path of putter head travel and wherein said putter head approaches and strikes said golf ball lying on a putting surface while said putter head is on its upswing whereby said ball is propelled with rotational spin across said putting surface.

5. A golf putting training device as set forth in claim 4 wherein said guide elements comprise interior facing surfaces defining grooves running substantially the lengths thereof and being respectively adapted to receive tongues provided at said first and second slider ends.

6. A golf putting training device for improving putting strokes, said device comprising, in combination:

a golf putter having a shaft and a putter head defined at a first end of said shaft, said putter head having a longitudinal axis;

a slider having first and second slider ends and being adapted to be used in connection with said golf putter;

a means for attaching said slider to said putter head;

a guide means comprising first and second elongated guide elements comprising interior facing surfaces defining grooves running substantially the lengths thereof and being respectively adapted to receive tongues provided at said first and second slider ends, said guide elements defining a generally arcuate desired path of putter head travel, the widths of said grooves varying along the lengths of the guide elements, whereby golfers having putting strokes with various radii of curvature may employ the device; and a spacing means for maintaining said guide elements disposed in horizontal, spaced parallelism, said slider and said putter head being translated along a desired path of putter head travel whereby said putter head approaches and strikes a golf ball lying on said putting surface and positioned proximate an end of said guide elements and intermediate them while said putter head is on its upswing, whereby said ball is propelled with rotational spin across said putting surface.

* * * * *